US009159335B2

(12) United States Patent
Kim et al.

(10) Patent No.: US 9,159,335 B2
(45) Date of Patent: Oct. 13, 2015

(54) APPARATUS AND METHOD FOR NOISE ESTIMATION, AND NOISE REDUCTION APPARATUS EMPLOYING THE SAME

(75) Inventors: Kyu-hong Kim, Suwon-si (KR); Kwang-cheol Oh, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 1177 days.

(21) Appl. No.: 12/557,347

(22) Filed: Sep. 10, 2009

(65) Prior Publication Data

US 2010/0092000 A1 Apr. 15, 2010

(30) Foreign Application Priority Data

Oct. 10, 2008 (KR) ..... 10-2008-0099699

(51) Int. Cl.

| | |
|---|---|
| ***H04R 29/00*** | (2006.01) |
| ***H04R 3/00*** | (2006.01) |
| ***G10L 21/0208*** | (2013.01) |
| *G10L 21/0216* | (2013.01) |

(52) U.S. Cl.

CPC ... *G10L 21/0208* (2013.01); *G10L 2021/02161* (2013.01)

(58) Field of Classification Search

CPC ..... G10L 21/0208; G10L 2021/02161; G10L 2021/02166; H04R 29/00; H04R 29/005

USPC ..... 381/92, 94.1, 94.2, 94.7, 17, 57, 58, 72, 381/74, 104, 106, 107, 321

See application file for complete search history.

(56) References Cited

U.S. PATENT DOCUMENTS

| | | | | |
|---|---|---|---|---|
| 6,339,758 | B1 | 1/2002 | Kanazawa et al. | |
| 7,139,703 | B2 | 11/2006 | Acero | |
| 7,158,932 | B1 | 1/2007 | Furuta | |
| 7,164,620 | B2 | 1/2007 | Hoshuyama | |
| 7,165,026 | B2 | 1/2007 | Acero | |
| 7,454,332 | B2 | 11/2008 | Koishida et al. | |
| 7,533,017 | B2 | 5/2009 | Gotanda et al. | |
| 7,562,013 | B2 | 7/2009 | Gotanda et al. | |
| 7,706,550 | B2 | 4/2010 | Amada et al. | |
| 7,957,542 | B2 | 6/2011 | Sarrukh et al. | |
| 8,213,633 | B2 | 7/2012 | Kobayashi et al. | |
| 2002/0064287 | A1* | 5/2002 | Kawamura et al. | 381/92 |

(Continued)

FOREIGN PATENT DOCUMENTS

| | | |
|---|---|---|
| CN | 1851806 A | 10/2006 |
| CN | 1947171 A | 4/2007 |

(Continued)

OTHER PUBLICATIONS

Chinese Office Action issued Nov. 9, 2011, in Counterpart Chinese Patent Application No. 200910177314.8 (6 pages).

Steven F. Boll, "Suppression of Acoustic Noise in Speech Using Spectral Subtraction," Apr. 1979, IEE Transaction on Acoustics, Speech, and Signal Processing, vol. ASSP-27, No. 2, pp. 113-120.

(Continued)

*Primary Examiner* — Vivian Chin
*Assistant Examiner* — William A Jerez Lora
(74) *Attorney, Agent, or Firm* — NSIP Law

(57) ABSTRACT

Provided are an apparatus and method for estimating noise and a noise reduction apparatus employing the same. The noise estimation apparatus estimates noise by blocking audio signals from a direction of a target sound source from received audio signals, and compensating for distortions from directivity gains of a target sound blocker blocking the audio signals from the target sound source.

19 Claims, 6 Drawing Sheets

(56) References Cited

U.S. PATENT DOCUMENTS

| | | | | |
|---|---|---|---|---|
| 2003/0147538 | A1* | 8/2003 | Elko | 381/92 |
| 2003/0177007 | A1 | 9/2003 | Kanazawa et al. | |
| 2005/0047611 | A1 | 3/2005 | Mao et al. | |
| 2005/0149320 | A1 | 7/2005 | Kajala et al. | |
| 2005/0212972 | A1* | 9/2005 | Suzuki | 348/607 |
| 2006/0013412 | A1* | 1/2006 | Goldin | 381/94.1 |
| 2006/0265219 | A1 | 11/2006 | Honda | |
| 2006/0293887 | A1 | 12/2006 | Zhang et al. | |
| 2007/0244698 | A1* | 10/2007 | Dugger et al. | 704/228 |
| 2007/0273585 | A1* | 11/2007 | Sarroukh et al. | 342/379 |
| 2008/0059165 | A1 | 3/2008 | Furuta | |
| 2008/0154592 | A1* | 6/2008 | Tsujikawa | 704/233 |
| 2008/0175408 | A1 | 7/2008 | Mukund et al. | |
| 2008/0189104 | A1 | 8/2008 | Zong et al. | |
| 2009/0086998 | A1* | 4/2009 | Jeong et al. | 381/119 |
| 2012/0308039 | A1 | 12/2012 | Kobayashi et al. | |

FOREIGN PATENT DOCUMENTS

| | | | |
|---|---|---|---|
| JP | 10-126878 | A | 5/1998 |
| JP | 2001-134287 | A | 5/2001 |
| JP | 2002-099297 | A | 4/2002 |
| JP | 2003-271191 | A | 9/2003 |
| JP | 2005-84244 | | 3/2005 |
| JP | 2005-091732 | | 4/2005 |
| JP | 2005-195955 | A | 7/2005 |
| JP | 2006-197552 | A | 7/2006 |
| JP | 2008-236077 | A | 10/2008 |
| KR | 10-2006-0046450 | | 5/2006 |
| KR | 10-2006-0119729 | | 11/2006 |
| KR | 10-2008-0019222 | | 3/2008 |
| KR | 1020080052803 | | 6/2008 |
| WO | WO 2004-034734 | | 4/2004 |
| WO | WO 2005/106841 | A1 | 11/2005 |
| WO | WO 2006/077745 | A1 | 7/2006 |

OTHER PUBLICATIONS

Y.Ephraim, et al., "Speech Enhancement Using Optimal Non-Linear Spectral Amplitude Estimation," 1983, Department of Electrical Engineering Technion-Israel Institute of Technology, Technion City, Haifa 32000, Israel, pp. 1118-1121.

Y.Ephraim, et al., "Speech Enhancement Using a Minimum Mean-Square Error Short-Time Spectral Amplitude Estimator," Dec. 1984, IEEE Transactions on Acoustic, Speech, and Signal Processing vol. ASSP-32, No. 6, pp. 1109-1121

Robert J. McAulay, "Speech Enhancement Using a Soft-Decision Noise Suppression Filter," Apr. 1980, IEEE Transactions on Acoustic, Speech, and Signal Processing vol. ASSP-28, No. 2, pp. 137-145.

Ivan Tashev, "Gain Self-Calibration Procedure for Microphone Arrays," 2004, ICME, Microsoft Research, One Microsoft Way, WA 98052,USA, pp. 983-986.

Jae S. Lim, "Enhancement and Bandwidth Compression of Noisy Speech," Dec. 1979, Proceeding of the IEEE, vol. 67, No. 12, pp. 1586-1604.

Japenese Office Action issued May 1, 2013 with respect to counterpart Japanese Application No. 2009-235217 (5 pages, in Japanese, with English translation).

Satoshi et al. "The Improvement of Precision in Sound Separation Using Temporal Continuity", Acoustical Society of Japan's Fall Research Symposium (2006) 491-492.

Chinese Office Action issued on Jan. 20, 2014 in counterpart Chinese Application 201210251379.4 (21 pages, in Chinese, with complete English Translation).

Japanese Office Action issued on April 1, 2014 in counterpart Japanese Application 2009-235217 (5 pages, in Japanese, with complete English translation).

Extended European Search Report issued Oct. 13, 2014 in counterpart European Patent Application No. 09172293.4 (8 pages).

Korean Office Action issued on Jul. 28, 2015 in counterpart Korean Application No. 10-2009-0085511 (5 pages in English, 6 pages in Korean).

* cited by examiner

APPARATUS AND METHOD FOR NOISE ESTIMATION, AND NOISE REDUCTION APPARATUS EMPLOYING THE SAME

CROSS-REFERENCE TO RELATED APPLICATION(S)

This application claims the benefit under 35 U.S.C. §119 (a) of Korean Patent Application No. 10-2008-0099699, filed on Oct. 10, 2008 in the Korean Intellectual Property Office, the disclosure of which is incorporated herein in its entirety by reference for all purposes.

BACKGROUND

1. Field

The following description relates to audio signal processing, and more particularly, to an apparatus and method for estimating noise, and a noise reduction apparatus employing the same.

2. Description of Related Art

Voice telephony using communication terminals such as mobile phones may not ensure high voice quality in a noisy environment. In order to enhance voice quality in noisy environments, technology to estimate background noise components to extract only the actual voice signals is desired.

As technology develops, voice-based applications for various terminals such as camcorders, notebook PCs, navigation systems, game machines, and the like, which operate in response to voice or store audio data are emerging. Accordingly, technology for reducing or eliminating background noise to extract high-quality voice is increasingly needed.

Various methods for estimating or reducing background noise have been proposed. However, it has been difficult to obtain a desired noise reduction or elimination performance where the statistical characteristics of noise change with time or where unexpected sporadic noise is generated upon initial operation for updating the statistical characteristics of noise.

SUMMARY

According to one general aspect, there is provided a noise estimation apparatus including an audio input unit to receive audio signals from a plurality of directions and transform the audio signals into frequency-domain signals, a target sound blocker to block audio signals coming from a direction of a target sound source, and a compensator to compensate for distortions from directivity gains of the target sound blocker.

The audio input unit may include two microphones adjacent to each other from 1 cm to 8 cm in distance, and transform audio signals received through the two microphones into frequency-domain signals.

The target sound blocker may block the audio signals from the target sound source by calculating differences between the audio signals received through the two microphones.

The compensator may calculate weights of the audio signals in which the audio signals from the target sound source are blocked, based on an average value of the audio signals in which the audio signals from the target sound source are blocked, and multiply the audio signals in which the audio signals from the target sound source are blocked by the corresponding weights.

The noise estimation apparatus may further include a target sound detector to detect the audio signals from the target sound source, and in a section where the audio signals from the target sound source are not detected, calculate a scaling coefficient which corresponds to a ratio of a magnitude of an audio signal received in the section relative to noise components estimated by the compensator, wherein the compensator may multiply the estimated noise components by the scaling coefficient.

The scaling coefficient may be calculated and updated in the section where the audio signals from the target sound source are not detected, and in a section where the audio signals from the target sound source are detected, a scaling coefficient that is previously calculated may be used.

The noise estimation apparatus may further include a gain calibrator to calibrate the two microphones to equalize gains of the two microphones.

The target sound blocker may output audio signal in which the audio signals from the target sound source are blocked.

According to another aspect, there is provided a noise reduction apparatus including a noise estimator configured to receive audio signals from a plurality of directions, transform the audio signals into frequency-domain signals, block audio signals coming from a direction of a target sound source from the frequency-domain signals, and compensate for gain distortions of the audio signals in which the audio signals from the target sound source are blocked, so as to is estimate noise components, and a noise reduction filter to remove the noise components estimated by the noise estimator using a filter coefficient calculated based on the estimated noise components.

The noise estimator may include two microphones adjacent to each other from 1 cm to 8 cm in distance, and the noise estimator may transform audio signals received through the two adjacent microphones into frequency-domain signals, calculate differences between the frequency-domain signals to block the audio signals from the target sound source, calculate weights of the audio signals in which the audio signals from the target sound source are blocked, using an average value of the audio signals in which the audio signals from the target sound source are blocked, and multiply the audio signals in which the audio signals from the target sound source are blocked by the corresponding weights.

According to still another aspect, there is provided a noise estimation method of a noise estimation apparatus, the method including receiving audio signals from a plurality of directions and transforming the audio signals into frequency-domain signals, blocking audio signals from a direction of a target sound source from the frequency-domain signals, compensating for gain distortions of the audio signals in which the audio signals from the target sound source are blocked.

The receiving of the audio signals may include receiving audio signals using two microphones adjacent to each other from 1 cm to 8 cm in distance, and the blocking of the audio signals may include blocking the audio signals from the target sound source by calculating differences between the audio signals received through the two microphones.

The compensating may include calculating weights of the audio signals in which the audio signals from the target signal source are blocked, using an average value of the audio signals in which the audio signals from the target sound source are blocked, and multiplying the is audio signals in which the audio signals from the target sound source are blocked by the corresponding weights.

The compensating may include detecting the presence of the audio signals from the target sound source, and in a section where the audio signals from the target sound source are not detected, calculating a scaling coefficient which corresponds to a ratio of a magnitude of an audio signal received in the section relative to previously calculated noise components.

The scaling coefficient may be calculated and updated in the section where the audio signals from the target sound source are not detected, and in a section where the audio signals from the target sound source are detected, a scaling coefficient that is previously calculated may be used.

The noise estimation apparatus may include two microphones, the method may further include calibrating the two microphones to equalize gains of the two microphones, and the receiving of the audio signals may include receiving audio signals using the calibrated two microphones.

According to yet another aspect, there is provided an apparatus for reducing noise, including an audio input unit having a plurality of microphones, which receives audio signals from a plurality of directions and transforms the audio signals into frequency-domain signals, a target sound blocker which blocks an audio signal coming from a direction of a target sound source from the frequency-domain signals, by calculating differences between audio signals received by the plurality of microphones, and outputs audio signals in which the audio signal from the target sound source is blocked, and a noise reduction unit which removes the audio signals in which the audio signal from the target sound source is blocked, to output the audio signal from the target sound source.

The noise reduction unit may be a filter which removes the audio signals in which the is audio signal from the target sound source is blocked, using a filter coefficient determined based on the audio signals in which the audio signal from the target sound source is blocked.

The apparatus may further include a compensator which compensates for distortions from directivity gains of the target sound blocker.

The compensator may calculate weights of the audio signals in which the audio signal from the target sound source is blocked, based on an average value of the audio signals in which the audio signal from the target sound source is blocked, and multiply the audio signals in which the audio signal from the target sound source is blocked by the corresponding weights.

The apparatus may further include a target sound detector which detects the audio signal from the target sound source, and in a section where the audio signal from the target sound source is not detected, calculates a scaling coefficient which corresponds to a ratio of a magnitude of an audio signal received in the section relative to noise components estimated by the compensator, wherein the compensator multiplies the estimated noise components by the scaling coefficient.

The scaling coefficient may be calculated and updated in the section where the audio signal from the target sound source is not detected, and in a section where the audio signals from the target sound source is detected, a scaling coefficient that is previously calculated may be used.

The apparatus may further include a gain calibrator which calibrates the plurality of microphones to equalize gains of the microphones.

Other features and aspects will be apparent from the following detailed description, the drawings, and the claims.

Figure 1:
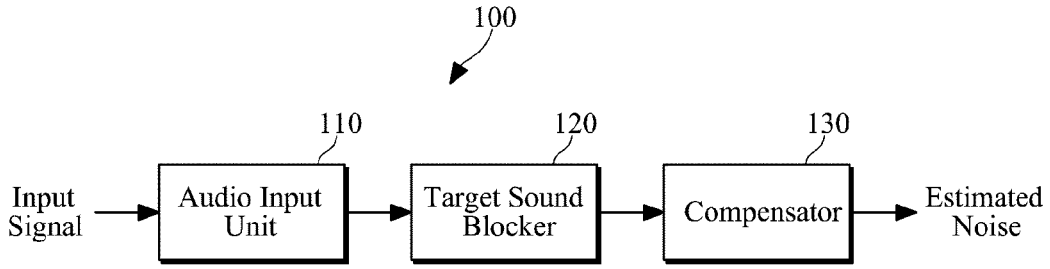
FIG. 1 is a block diagram illustrating an exemplary noise estimation apparatus.

Throughout the drawings and the detailed description, unless otherwise described, the same drawing reference numerals will be understood to refer to the same elements, features, and structures. The relative size and depiction of these elements may be exaggerated for clarity, illustration, and convenience.

DETAILED DESCRIPTION

The following detailed description is provided to assist the reader in gaining a comprehensive understanding of the methods, apparatuses, and/or systems described herein. Accordingly, various changes, modifications, and equivalents of the systems, apparatuses and/or methods described herein will be suggested to those of ordinary skill in the art. Also, descriptions of well-known functions and constructions may be omitted for increased clarity and conciseness.

FIG. 1 shows an exemplary noise estimation apparatus 100.

As shown in FIG. 1, the noise estimation apparatus 100 includes an audio input unit 110, is a target sound blocker 120, and a compensator 130.

The audio input unit 110 receives audio signals from a plurality of directions and transforms them into frequency-domain signals. The target sound blocker 120 blocks audio signals coming from the direction of a target sound source. The compensator 130 compensates for gain distortions from the target sound blocker 120.

As one example, the audio input unit 110 includes two microphones (not shown) which are adjacent to each other, and transforms audio signals received by the microphones into frequency-domain signals. The transformation may be, for example, a Fourier transformation. Further exemplary details including the arrangement and number of microphones, the location of a target-sound source, and the locations of noise sources will be described with reference to FIG. 2.

In the example of audio input unit 110 having two microphones, the target sound blocker 120 blocks the target sound by calculating the differences between the audio signals received by the two microphones. For example, two omnidirectional microphones for receiving audio signals from a plurality of directions are spaced apart by a predetermined distance (for example, 1 cm), so that audio signals coming from, for example, a front direction in which the target sound is generated are blocked and audio signals coming from different directions are received.

For example, a distance between two microphones may be from 1 cm to 8 cm. If a distance between two microphones is under 1 cm, overall audio signals coming from a plurality of directions may be reduced. And if a distance between two microphones is over 8 cm, audio to signals coming from directions except a direction of target source may be blocked.

As an illustration, where frequency-transformed values of audio signals received by the microphones are $S_1(f)$ and $S_2(f)$, a frequency-transformed value B(f) of an audio signal in which target sound is blocked may be calculated by Equation 1:

$$B(f)=w_i(f)\cdot S_1(f)+w_2(f)\cdot S_2(f), \quad \text{[Equation 1]}$$

where $w_1(f)$ and $w_2(f)$ are coefficients for blocking target sound and may be set appropriately through an undue experiment. For example, where $w_1(f)$ and $w_2(f)$ are set to +1 and −1, respectively, the frequency-transformed value B(f) of the audio signal in which target sound is blocked becomes the difference between the frequency-transformed values $S_1(f)$ and $S_2(f)$ of the audio signals received by the microphones.

Where $w_1(f)$ and $w_2(f)$ are set to +1 and −1, respectively, since audio signals received from the front direction of the two microphones, that is, from the direction of a target-sound source, are ideally the same, and audio signals received from other directions are different from each other, only the audio signals received from the front direction of the two microphones ideally become zero. Accordingly, the target sound received from the front direction may be blocked.

The audio signal in which target sound is blocked may be noise components. However, the frequency characteristics of an audio signal output from the target sound blocker 120 may vary significantly depending on, for example, the microphone array aperture size, number of microphones, and so on. Accordingly, to reduce errors in noise estimation, the compensator 130 may be used to calculate weights based on an average value of audio signals in which target sound is blocked, and multiply the audio signals by the corresponding weights, respectively.

A directivity pattern D(f, ϕ) of the audio signals in which target sound is blocked, which is obtained by the target sound blocker 120, may be calculated by Equation 2:

$$D(f,\phi)=\sum_{n=-\frac{N-1}{2}}^{\frac{N-1}{2}} w_n(f)e^{j\frac{2\pi}{\lambda}nd\cos\phi}, \quad \text{[Equation 2]}$$

where N represents the number of microphones, d represents distance between the microphones, ϕ represents direction, f represents frequency, and $w_n(f)$ represents weight relative to a microphone located at coordinate n, wherein the weights are related to the coefficients for blocking target in Equation 1. For example, if the number of the microphones are two, the $w_{-0.5}(f)$ and $w_{0.5}(f)$ are +1 and −1, respectively.

The compensator 130 receives the audio signal B(f) in which target sound is blocked, calculated by Equation 1, and multiplies the audio signal B(f) by the corresponding weight, so as to estimate noise components in real time. The weight may be calculated by Equation 3:

$$W(f)=\frac{\alpha}{\frac{1}{\pi}\int_0^{\pi}|D(f,\phi)|\,d\phi}, \quad \text{[Equation 3]}$$

where α is a constant which is a global scaling coefficient, and is applied to all frequency components to adjust weights. The α value may be obtained through an undue experiment.

As a result, the noise components estimated by the compensator 130 may be written by Equation 4:

$$\tilde{N}_\alpha(f)=|B(f)\cdot W(f)|, \quad \text{[Equation 4]}$$

As shown in Equation 4, noise of a current frame may be estimated without using noise information of the previous frame, and the existence and amount of directional noise may be estimated in real time regardless of detection of target sound.

An exemplary embodiment has been described with two microphones for an illustrative to purpose. Accordingly, it is understood that the number of microphones can be other than two. For example, an audio input unit of a noise estimation apparatus may have three or more microphones. Based on the number of microphones, an appropriate combination of coefficients w may be selected to block audio signals received from a direction of a target-sound source.

Figure 2:
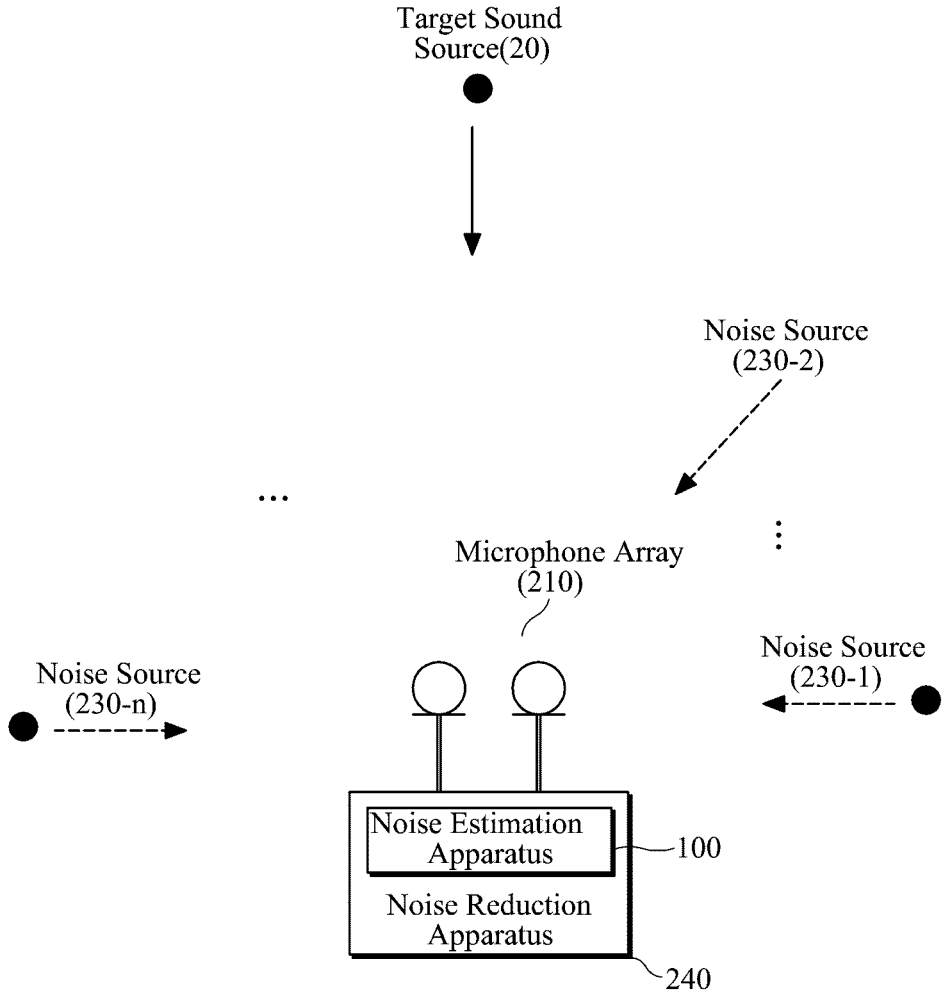
FIG. 2 is a diagram illustrating a location relationship between sound sources and an arrangement of a microphone array of the noise estimation apparatus of FIG. 1.

FIG. 2 shows a location relationship between sound sources 220 and 230-1 through **230-*n*, and an arrangement of a microphone array 210 of the noise estimation apparatus 100 of FIG. 1**.

As shown, the microphones comprising the microphone array 210 are, for example, adjacent to each other, and the target-sound source 220 is located, for example, in front of (vertically above/below) the microphone array 210 so that audio signals are input to the microphone array 210. The audio signals input to the microphone array 210 are transferred to a noise reduction apparatus 240 to perform noise estimation and noise reduction.

The noise reduction apparatus 240 blocks audio signals received from the target-sound source 220 by, for example, the target sound blocking method described above with reference to FIG. 1, and extracts noise signals received from noise sources 230-1, 230-2, . . . , **230-*n* located in directions other than the direction in which the target-sound source 220** is located.

Figure 3:
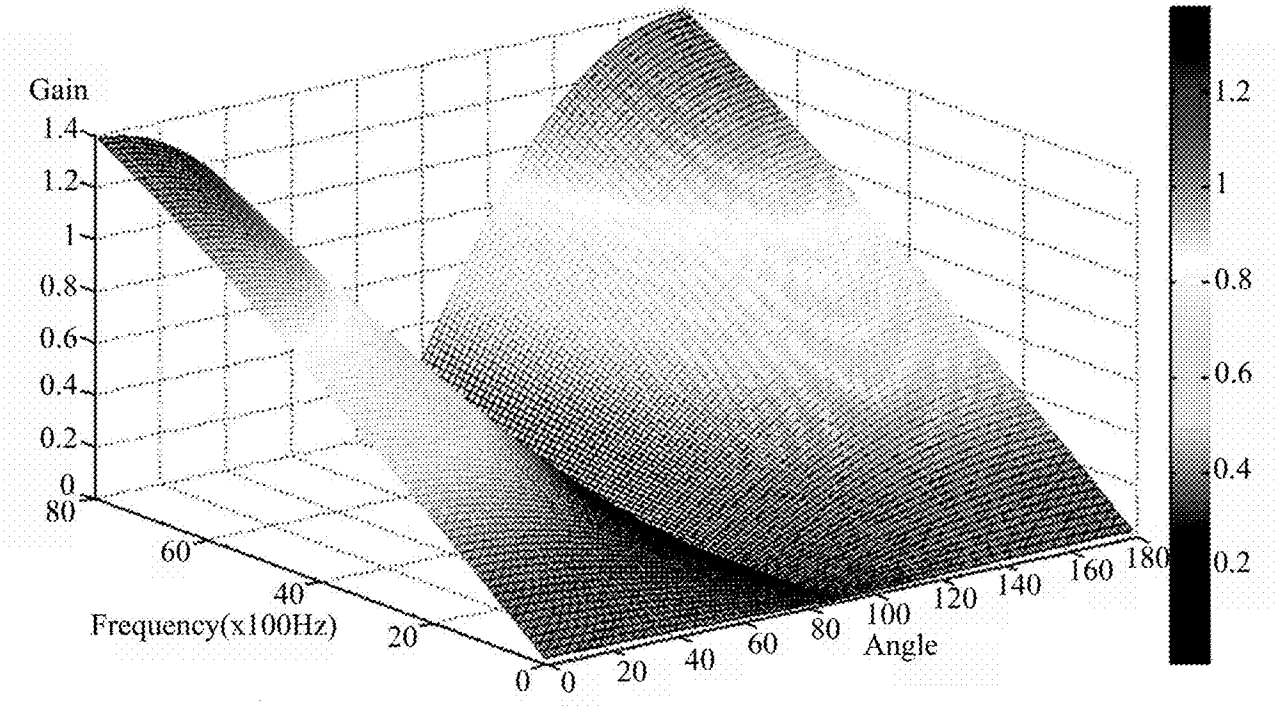
FIG. 3 is a graph illustrating a directivity pattern obtained by a target sound blocker of the noise estimation apparatus of FIG. 1.

FIG. 3 shows an exemplary directivity pattern obtained by the target sound blocker 120 of the noise estimation apparatus 120 of FIG. 1.

Referring to FIG. 2, in the view shown, the angle between the microphone array 210 and the target-sound source 220 is 90°. Referring to FIG. 3, all frequency bands received at an angle of 90° at which target sound is received have a gain of about zero. That is, target sound received at the angle of 90° is blocked, and the more the angle of the sound sources deviates from 90°, the larger the gain becomes. The gain depends on frequency band. For example, gains of high-frequency components are larger and gains of low-frequency components are smaller.

Meanwhile, the directivity pattern may depend on the target sound blocker 120.

As shown in FIG. 3, the gain differences of the directivity pattern according to direction of noise become greater at higher frequencies. Accordingly, weights w(f) calculated by the compensator 130 (see FIG. 1) may be used to average the gains of the directivity pattern.

Figure 4:
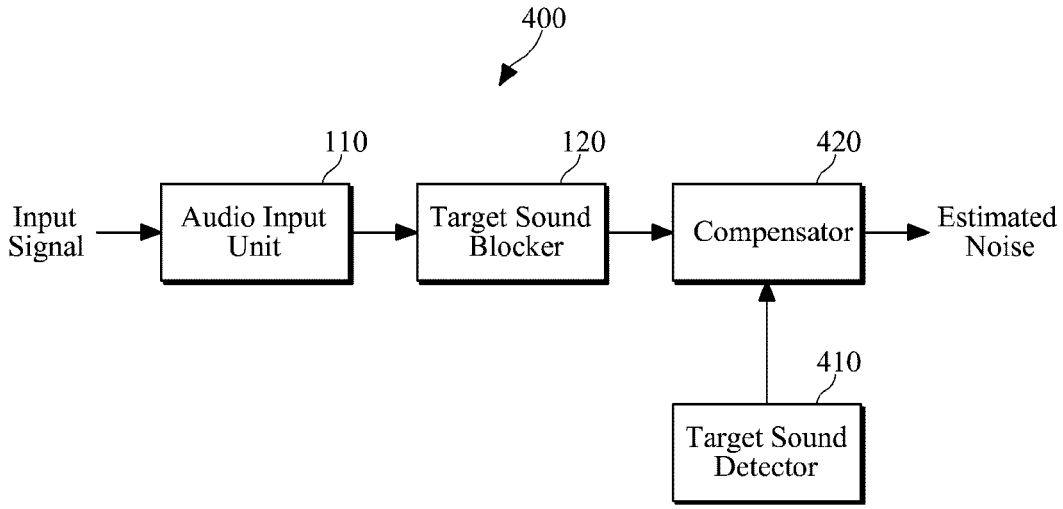
FIG. 4 is a block diagram illustrating another exemplary noise estimation apparatus having a target sound detector.

FIG. 4 shows another exemplary noise estimation apparatus 400 having a target sound is detector 410.

The target sound detector 410 detects the presence or absence of target sound, and in a section where target sound is not detected, that is, in a noise section, calculates a scaling coefficient which corresponds to a ratio of the magnitude of an audio signal received in the noise section relative to noise components calculated by the compensator 420, and provides the scaling coefficient to the compensator 420. Then to estimate the noise components, the compensator 420 multiplies the previously calculated noise components by the scaling coefficient calculated by the target sound detector 410.

Although the compensator 420 compensates for the gains of the directivity pattern using the average value as described above, the compensator 420 may not compensate for directivities of noise signals correctly at all frequencies. Accordingly, the exemplary noise estimation apparatus 400 compensates for variation of gain according to direction of noise, in a mute section where target sound is not detected, under the assumption that the direction of noise does not sharply change as the characteristics of noise change with time. That is, where the target sound detector 410 detects a noise section where target sound does not exist, the previously estimated noise is adjusted by calculating a ratio of the magnitude of a noise signal received in the noise section relative to a noise signal calculated by Equation 4.

The ratio, that is, a local scaling coefficient β(f) may be calculated by Equation 5:

$$\beta(f) = \frac{|S(f)|}{\tilde{N}_a(f)} \quad \text{[Equation 5]}$$

Since calculation of an estimated noise value in a frequency domain may be performed in units of frames, Equation 5 may be rewritten as Equation 6 including frame information:

$$\beta(n, f) = \begin{cases} \gamma \cdot \frac{|S(n, f)|}{\tilde{N}_a(n, f)} + (1-\gamma) \cdot \beta(n-1, f), & \text{if } n^{th} \text{ frame has no target signal} \\ \beta(n-1, f) & \text{otherwise} \end{cases} \quad \text{[Equation 6]}$$

That is, the local scaling coefficient β(f) is recalculated and updated in sections where target sound is not detected, and in sections where target sound is detected, the previous local is scaling coefficient is used as is. In Equation 6, γ is an update rate, and as γ approaches 1, the target sound detector 410 responds more quickly to changes in input noise, while as γ approaches 0, it responds with less sensitivity to sudden errors. Accordingly, an estimated noise value reflecting the local scaling coefficient β(f) output from the compensator 420 may be calculated by Equation 7:

$$\tilde{N}_b(f) = B(f) \cdot W(f) \cdot \beta(f) \quad \text{[Equation 7]}$$

It is understood that general voice activity detection methods may be used for the target sound detector 410, and accordingly, further description is omitted for conciseness. It is also understood that various known or to be known methods may be used to detect target sound.

Figure 5:
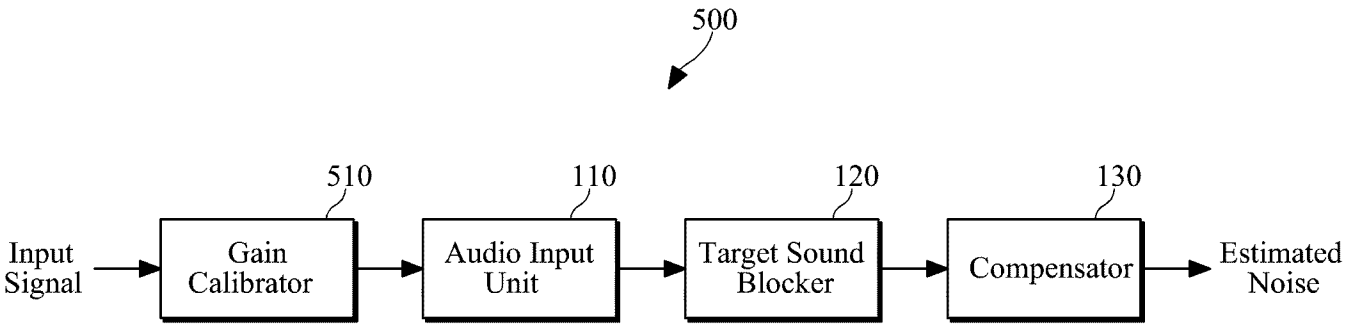
FIG. 5 is a block diagram illustrating another exemplary noise estimation apparatus having a gain calibrator.

FIG. 5 shows another exemplary noise estimation apparatus 500 having a gain calibrator 510.

The gain calibrator 510 calibrates, for example, two microphones to which target sound is input, to equalize gains of the microphones. Generally, different microphones manufactured according to a standard may have different gains due to errors in manufacturing processes. If two microphones have a gain difference, the target sound blocker 120 may not block target to sound correctly. Accordingly, gain calibration may be performed before receiving audio signals through microphones.

The gain calibration may be performed once. However, since the gain may depend on environmental factors such as temperature or humidity, gain calibration may also be performed at regular time intervals. It is understood that general gain calibration methods may be used, and accordingly, further description is omitted for conciseness.

Figure 6:
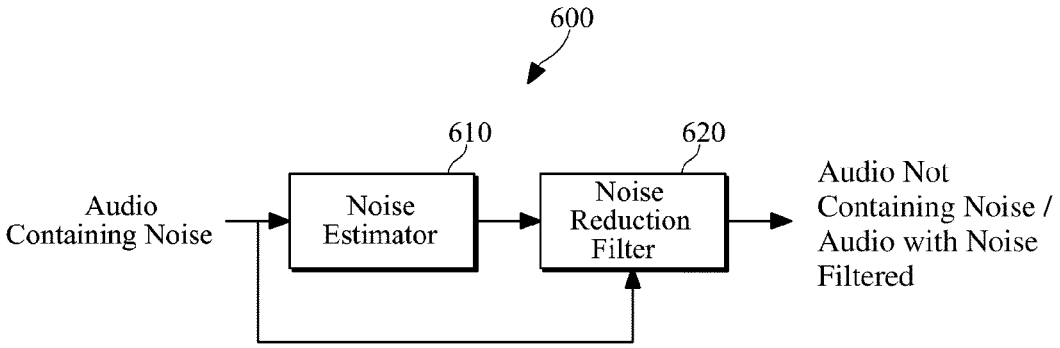
FIG. 6 is a block diagram illustrating an exemplary noise reduction apparatus having a noise estimator.

FIG. 6 shows an exemplary noise reduction apparatus 600 having a noise estimator.

Referring to FIG. 6, the noise reduction apparatus 600 includes a noise estimator 610 and a noise reduction filter 620.

The noise estimator 610 may perform noise estimation described above with reference to FIGS. 1 through 5. For example, to estimate noise, the noise estimator 610 receives audio signals from a plurality of directions, transforms them into frequency-domain signals, blocks audio signals coming from a direction of a target sound source to be detected from the frequency-domain signals, and compensates for gain distortions of the resultant audio signals in which target sound is blocked.

The noise estimator 610 transforms audio signals received through, for example, two adjacent microphones into frequency-domain signals, calculates differences between the frequency-domain signals to block target sound, calculates weights of the audio signals in which target sound is blocked using an average value of the audio signals, and multiplies the audio signals in which the target sound is blocked by the corresponding weights, so as to estimate noise components.

The noise reduction filter 620 may be designed based on filter coefficients that are calculated using the estimated noise components. The noise reduction filter 620 may be one of various filters, such as spectral subtraction, a Wiener filter, an amplitude estimator, and the like.

Figure 7:
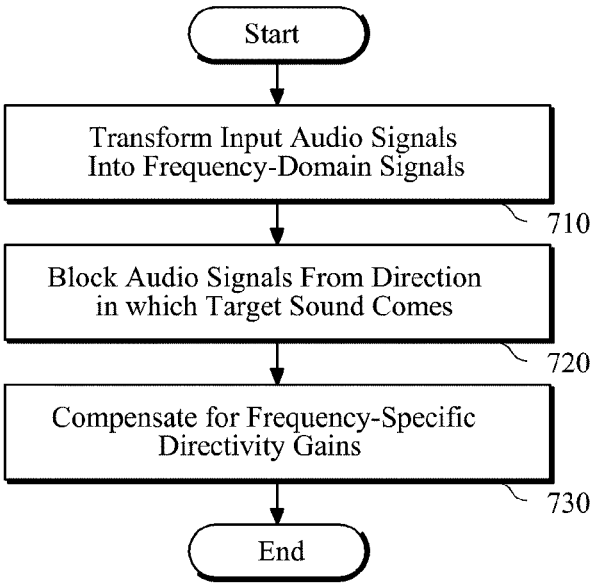
FIG. 7 is a flowchart illustrating an exemplary noise estimation method.

FIG. 7 is a flowchart illustrating an exemplary noise estimation method. It is understood that an exemplary noise estimation apparatus described above may perform the method.

In operation 710, audio signals are received from a plurality of directions and transformed into frequency-domain signals.

In operation 720, audio signals coming from a direction of a target sound source to be detected are blocked from among the frequency-domain signals. For example, by calculating differences between audio signals received through, for example, two adjacent microphones, only target sound may be blocked.

In operation 730, the distortions from the directivity gains of a target sound blocker are compensated for. For example, weights of the audio signals in which target sound is blocked are calculated based on an average value of the audio signals, and the audio signals are multiplied by the corresponding weights, so as to estimate noise components. To estimate the noise components, the presence or absence of target sound may be detected, in sections where no target sound is detected, a ratio (a scaling coefficient) of the magnitude of an input audio signal relative to the previously estimated noise components may be calculated, and the previously estimated noise components may be multiplied by the scaling coefficient.

The scaling coefficient may be a local scaling coefficient described above. The local scaling coefficient may be recalculated and updated in sections where target sound is not detected, and in sections where target sound is detected, the previous scaling coefficient may be used as is.

In the operation 730, the spectral distortions originated from the directivity gains of the target sound blocker may be compensated for.

To equalize gains of the microphones, the microphones may be calibrated before the operation 710 of receiving audio signals.

According to examples described above, since estimation of non-stationary noise which changes with time is possible, audio or voice quality as well as audio or voice recognition performance may be improved in various apparatuses which receive audio or voice.

As one example, exemplary noise estimation method described above may be applied to communication terminals such as mobile phones to improve audio or voice quality. Because is noise estimation may be carried out uniformly over all frequency domains, and also in sections where audio or voice exists, effective or improved noise estimation may be possible.

According examples described above, there is provided an apparatus and method for estimating non-stationary noise by blocking target sound, and a noise reduction apparatus employing the same.

It is understood that the terminology used herein may be different in other applications or when described by another person of ordinary skill in the art. For example, a noise "reduction" filter or a noise "reduction" apparatus may also be referred to as a noise "elimination" filter or a noise "elimination" apparatus, respectively. Moreover, with respect to target sound described as being blocked, it is understood that a target sound blocker may not "completely" block target sound due to, for example, gain mismatch of microphones.

The methods described above may be recorded, stored, or fixed in one or more computer-readable media that includes program instructions to be implemented by a computer to cause a processor to execute or perform the program instructions. The media may also include, alone or in combination with the program instructions, data files, data structures, and the like. Examples of computer-readable media include magnetic media, such as hard disks, floppy disks, and magnetic tape; optical media such as CD ROM disks and DVDs; magneto-optical media, such as optical disks; and hardware devices that are specially configured to store and perform program instructions, such as read-only memory (ROM), random access memory (RAM), flash memory, and the like. Examples of program instructions include machine code, such as to produced by a compiler, and files containing higher level code that may be executed by the computer using an interpreter. The described hardware devices may be configured to act as one or more software modules in order to perform the operations and methods described above, or vice versa.

A number of exemplary embodiments have been described above. Nevertheless, it will is be understood that various modifications may be made. For example, suitable results may be achieved if the described techniques are performed in a different order and/or if components in a described system, architecture, device, or circuit are combined in a different manner and/or replaced or supplemented by other components or their equivalents. Accordingly, other implementations are within the scope of the following claims.

What is claimed is:

1. A noise estimation apparatus comprising:

an audio input unit configured to receive audio signals, with two microphones, from a plurality of directions and transform the received audio signals into frequency-domain representations of the received audio signals;

a target sound blocker configured to block, within the frequency-domain representations, audio signals coming from a direction of a target sound source and thereby produce target-blocked audio signals; and a compensator configured to compensate for distortions, within the target-blocked audio signals, resulting from directivity gains produced by the target sound blocker, wherein:

the target sound blocker blocks the audio signals coming from the direction of the target sound source and receives the other audio signals coming from the other directions different from the direction of the target sound source by calculating a difference between a first audio signal received by a first of the two microphones and a second audio signal received by a second of the two microphones, and the compensator calculates weights of the target-blocked audio signals, based on an average value of the target-blocked audio signals, and multiplies the target-blocked audio signals by the corresponding weights.

2. The noise estimation apparatus of claim 1, wherein the two microphones are adjacent to each other and 1 cm to 8 cm apart in distance.

3. The noise estimation apparatus of claim 1, further comprising:

a target sound detector configured to:

detect the audio signals coming from the direction of the target sound source, and calculate, in a time period in which the audio signals coming from the direction of the target sound source are not detected, a scaling coefficient which corresponds to a ratio of a magnitude of an audio signal received in the time period relative to noise components estimated by the compensator, wherein the compensator multiplies the estimated noise components by the scaling coefficient.

4. The noise estimation apparatus of claim 3, wherein:

the scaling coefficient is calculated and updated in the time period in which the audio signals coming from the direction of the target sound source are not detected, and in a time period in which the audio signals from the target sound source are detected, a scaling coefficient that is previously calculated is used.

5. The noise estimation apparatus of claim 2, further comprising a gain calibrator configured to calibrate the two microphones to equalize gains of the two microphones.

6. The noise estimation apparatus of claim 1, wherein the target sound blocker outputs the target-blocked audio signals.

7. A noise reduction apparatus comprising:

a noise estimator configured to:

receive audio signals, with two microphones, from a plurality of directions, transform the received audio signals into frequency-domain representations of the received audio signals, calculate differences between the frequency-domain representations, block, based upon the calculated differences and within the frequency-domain representations, audio signals coming from a direction of a target sound source and receive the other audio signals coming from the other directions different from the direction of the target sound source and, thereby, produce target-blocked audio signals, and compensate, within the target-blocked audio signals, for gain distortions generated in the production of the target-blocked audio signals so as to estimate noise components; and a noise reduction filter configured to remove from the received audio signals the noise components estimated by the noise estimator using a filter coefficient calculated based on the estimated noise components, wherein:

the noise estimator:

calculates weights of the target-blocked audio signals, using an average value of the target-blocked audio signals, and multiplies the target-blocked audio signals by the corresponding weights.

8. The noise reduction apparatus of claim 7, wherein the two microphones are adjacent to each other and 1 cm to 8 cm apart in distance.

9. A noise estimation method of a noise estimation apparatus, the method comprising:

receiving, with two microphones, audio signals from a plurality of directions and transforming the received audio signals into frequency-domain representations of the received audio signals;

calculating the difference between a first audio signal received by a first of the two microphones and a second audio signal received by a second of the two microphones;

blocking, based upon the calculated difference and within the frequency-domain representations, audio signals coming from a direction of a target sound source and receiving the other audio signals coming from the other directions different from the direction of the target sound source and, thereby, producing target-blocked audio signals; and compensating, within the target-blocked audio signals, for gain distortions created by blocking the audio signals coming from the direction of the target sound source, wherein the compensating comprises calculating weights of the target-blocked audio signals, using an average value of the target-blocked audio signals, and multiplying the target-blocked audio signals by the corresponding weights.

10. The noise estimation method of claim 9, wherein the two microphones are adjacent to each other and 1 cm to 8 cm apart in distance.

11. The noise estimation method of claim 9, wherein the compensating comprises:

detecting the presence of the audio signals coming from the direction of the target sound source, and calculating, in a time period in which the audio signals coming from the direction of the target sound source are not detected, a scaling coefficient which corresponds to a ratio of a magnitude of an audio signal received in the time period relative to previously calculated noise components.

12. The noise estimation method of claim 11, wherein:

the scaling coefficient is calculated and updated in the time period in which the audio signals from the target sound source are not detected, and in a time period in which the audio signals coming from the direction of the target sound source are detected, a scaling coefficient that is previously calculated is used.

13. The noise estimation method of claim 9, wherein:

the noise estimation apparatus includes the two microphones, the method further comprises calibrating the two microphones to equalize gains of the two microphones, and the receiving of the audio signals comprises receiving the audio signals using the calibrated two microphones.

14. An apparatus for reducing noise, comprising:

an audio input unit, having a plurality of microphones, configured to receive audio signals from a plurality of directions and transform the received audio signals into frequency-domain representations of the received audio signals;

a target sound blocker configured to block, within the frequency-domain representations, an audio signal coming from a direction of a target sound source and receive the other audio signals coming from the other directions different from the direction of the target sound source by calculating differences between audio signals received by the plurality of microphones, and output target-blocked audio signals in which the audio signal coming from the direction of the target sound source is blocked; and a noise reduction unit configured to remove the target-blocked audio signals from the received audio signals so as to output the audio signal coming from the direction of the target sound source, wherein the compensator calculates weights of the target-blocked audio signals, based on an average value of the target-blocked audio signals, and multiplies the target-blocked audio signals by the corresponding weights.

15. The apparatus of claim 14, wherein the noise reduction unit is a filter which removes the target-blocked audio signals using a filter coefficient determined based on the target-blocked audio signals.

16. The apparatus of claim 14, further comprising a compensator configured to compensate the target-blocked audio signals for distortions from directivity gains produced by the target sound blocker.

17. The apparatus of claim 16, further comprising:

a target sound detector configured to detect the audio signal coming from the direction of the target sound source, and calculate, in a time period in which the audio signal coming from the direction of the target sound source is not detected, a scaling coefficient which corresponds to a ratio of a magnitude of an audio signal received in the time period relative to noise components estimated by the compensator, wherein the compensator multiplies the estimated noise components by the scaling coefficient.

18. The apparatus of claim 17, wherein:

the scaling coefficient is calculated and updated in the time period in which the audio signal from the target sound source is not detected, and in a time period in which the audio signals coming from the direction of the target sound source is detected, a scaling coefficient that is previously calculated is used.

19. The apparatus of claim 17, further comprising a gain calibrator configured to calibrate the plurality of microphones to equalize gains of the microphones.

* * * * *